US008143970B2

(12) United States Patent
Moon et al.

(10) Patent No.: US 8,143,970 B2
(45) Date of Patent: Mar. 27, 2012

(54) PHASE SHIFTER HAVING A VARYING SIGNAL PATH LENGTH BASED ON THE ROTATION OF THE PHASE SHIFTER

(75) Inventors: Young-Chan Moon, Gyeonggi-do (KR); Ryoji Matsubara, Gyeonggi-do (KR); Nam-Il Kim, Gyeonggi-do (KR)

(73) Assignee: KMW Inc. (CN)

( * ) Notice: Subject to any disclaimer, the term of this patent is extended or adjusted under 35 U.S.C. 154(b) by 225 days.

(21) Appl. No.: 12/303,356

(22) PCT Filed: Jun. 20, 2007

(86) PCT No.: PCT/KR2007/002978

§ 371 (c)(1),
(2), (4) Date: Dec. 3, 2008

(87) PCT Pub. No.: WO2008/002032

PCT Pub. Date: Jan. 30, 2008

(65) Prior Publication Data

US 2009/0184780 A1 Jul. 23, 2009

(30) Foreign Application Priority Data

Jun. 26, 2006 (KR) ..... 10-2006-0057480

(51) Int. Cl.
*H01P 1/18* (2006.01)

(52) U.S. Cl. ..... 333/161

(58) Field of Classification Search ..... 333/161, 333/156

See application file for complete search history.

(56) References Cited

U.S. PATENT DOCUMENTS

| | | | | |
|---|---|---|---|---|
| 3,114,121 | A | 12/1963 | Jordan | |
| 5,994,983 | A * | 11/1999 | Andersson | 333/246 |
| 6,504,450 | B2 | 1/2003 | Kim et al. | |
| 6,850,130 | B1 | 2/2005 | Gottl et al. | |
| 2002/0135524 | A1 * | 9/2002 | Zimmerman et al. | 343/760 |
| 2003/0076198 | A1 * | 4/2003 | Phillips et al. | 333/161 |
| 2005/0046514 | A1 * | 3/2005 | Janoschka | 333/156 |
| 2006/0077098 | A1 * | 4/2006 | Zimmerman | 342/372 |

FOREIGN PATENT DOCUMENTS

| | | | |
|---|---|---|---|
| DE | 24 58 477 | A1 | 7/1976 |
| JP | 58075901 | A | 5/1983 |
| JP | 59-043602 | A | 3/1984 |
| JP | 06-077710 | A | 3/1994 |
| JP | 09-246826 | | 9/1997 |
| JP | 10-013103 | A | 1/1998 |
| KR | 1020020035574 | A | 5/2002 |
| KR | 1020020070032 | A | 9/2002 |
| WO | 03-019720 | A1 | 3/2003 |

* cited by examiner

*Primary Examiner* — Benny Lee

(57) ABSTRACT

Disclosed is a variable phase shifter, the variable phase shifter including: a fixed board which is fixedly provided in a housing, and consisting of a dielectric board, and consisting of a dielectric board, having a second transfer stripline having at least one arc-shaped output micro stripline on one surface; a rotating board rotatably provided within the housing while coming in contact with the one surface of the fixed board, and consisting of a dielectric board, having a second transfer stripline coupled to the arc-shaped output micro stripline on a surface where the rotating board comes in contact with the one surface of the fixed board even when the rotating board rotates; wherein both the sides of at least one output micro stripline of the fixed board are connected to an output port, and the other surface of the fixed board includes an input micro stripline, so that the other surface of the fixed board is electrically connected and receives an input signal.

16 Claims, 5 Drawing Sheets

PHASE SHIFTER HAVING A VARYING SIGNAL PATH LENGTH BASED ON THE ROTATION OF THE PHASE SHIFTER

TECHNICAL FIELD

The present invention relates to a variable phase shifter used for shifting and outputting the phase of an input signal, and more particularly to a variable phase shifter capable of distributing input signals and varying the degree of phase shift.

BACKGROUND ART

A communication equipment for linearly transmitting communication signals requires signal processors, such as a phase shifter that changes the phase of an input signal, and an attenuator that attenuates the strength of an input signal to a given magnitude. The phase shifter is used in widespread application fields. As an example, the phase shifter provides radio frequency signals with phase shift selective to a signal propagating the radio frequency signals. As already known, the phase shifter is adopted in various radio frequency applications, such as a phase array antenna system.

Especially, the variable phase shifter is used in various fields, such as RF analog signal processing for performing a phase modulation function, including beam control of a phase array antenna. The variable phase shifter for providing a phase difference between an input signal and an output signal is to appropriately delay the input signal, which may be implemented by simply varying the physical length of the transmission line, by varying the signal transfer speed within the transmission line in various ways, and so on. The phase shifter is commonly used in a structure of a variable phase shifter capable of varying the degree of phase shift, for example, by using a variable length of the transmission line, etc.

Recently, in a mobile communication system, there have been demands for a technology for harmoniously varying the phase of each radiating element of the phase array antenna in order to adjust the coverage of a base station by regulating the vertical beam angle of the phase array antenna of the base station. Keeping pace with such demands, phase shifters with various structures have been developed. Particularly, the variable phase shifter may have a structure for distributing an input signal into a plurality of output signals and appropriately adjusting the phase differences between the respective output signals. An example of a variable phase shifter with such a structure is disclosed in Korean Patent Registration No. 10-392130 (Title: "Phase Shifter Capable of Selecting Phase Shift Range", Inventors: RakJun Baek and Seungchol Lee). In this variable phase shifter, a dielectric having a predetermined dielectric constant is mounted between a signal input line and a signal output line so that the variable phase shifter changes the phase or magnitude of an input signal and outputs the phase- or magnitude-changed signal. With regard to this, not only must basic requirements, such as high-quality performance, be satisfied, but also it is very important to miniaturize the variable phase shifter from the viewpoint of miniaturization of a communication equipment.

Since mobile communication technology has recently, rapidly developed, and thus RF signal processing technology also has demanded high performance, much research is actively conducted to improve performance and to provide the variable phase shifter with a more efficient structure.

DISCLOSURE OF INVENTION

Technical Problem

Accordingly, the present invention has been made to solve the above-mentioned problems occurring in the prior art, and the present invention provides a variable phase shifter having more advanced performance. Also, the present invention provides a variable phase shifter whose overall size can be reduced and which has a more stable mechanical structure.

Technical Solution

In accordance with an aspect of the present invention, there is provided a variable phase shifter comprising: a housing; a fixed board fixedly provided within the housing, receiving an input signal through a first transfer stripline provided on one surface thereof, which is a micro stripline formed with an open end, and having at least one arc-shaped output micro stripline outside the first transfer stripline; and a rotating board rotatably provided within the housing while coming in contact with the one surface of the fixed board, and having a second transfer stripline on a surface where the rotating board comes in contact with the one surface of the fixed board, wherein coupling between the striplines is made and thus at least one output signal is provided even when the rotating board rotates.

Advantageous Effects

As described above, since a variable phase shifter according to the present invention distributes an input signal through a meander line coupling structure using a fixed board and a rotating board, and varies the phase by generating a length difference among a plurality of transmission lines, the overall size of the variable phase shifter can become smaller, mechanical abrasion due to a mechanical contact between striplines can be reduced, and more improved performance can be implemented.

BRIEF DESCRIPTION OF THE DRAWINGS

The above and other objects, features, and advantages of the present invention will be more apparent from the following detailed description taken in conjunction with the accompanying drawings, in which.

BEST MODE FOR CARRYING OUT THE INVENTION

Hereinafter, an exemplary embodiment according to the present invention will be described with reference to the accompanying drawings. In the following description, details, such as specific constituent elements, are shown.

However, these are given only for providing the general understanding of the present invention, and it will be understood by those skilled in the art that modifications or changes may be made to them within the scope of the present invention.

Figure 1:
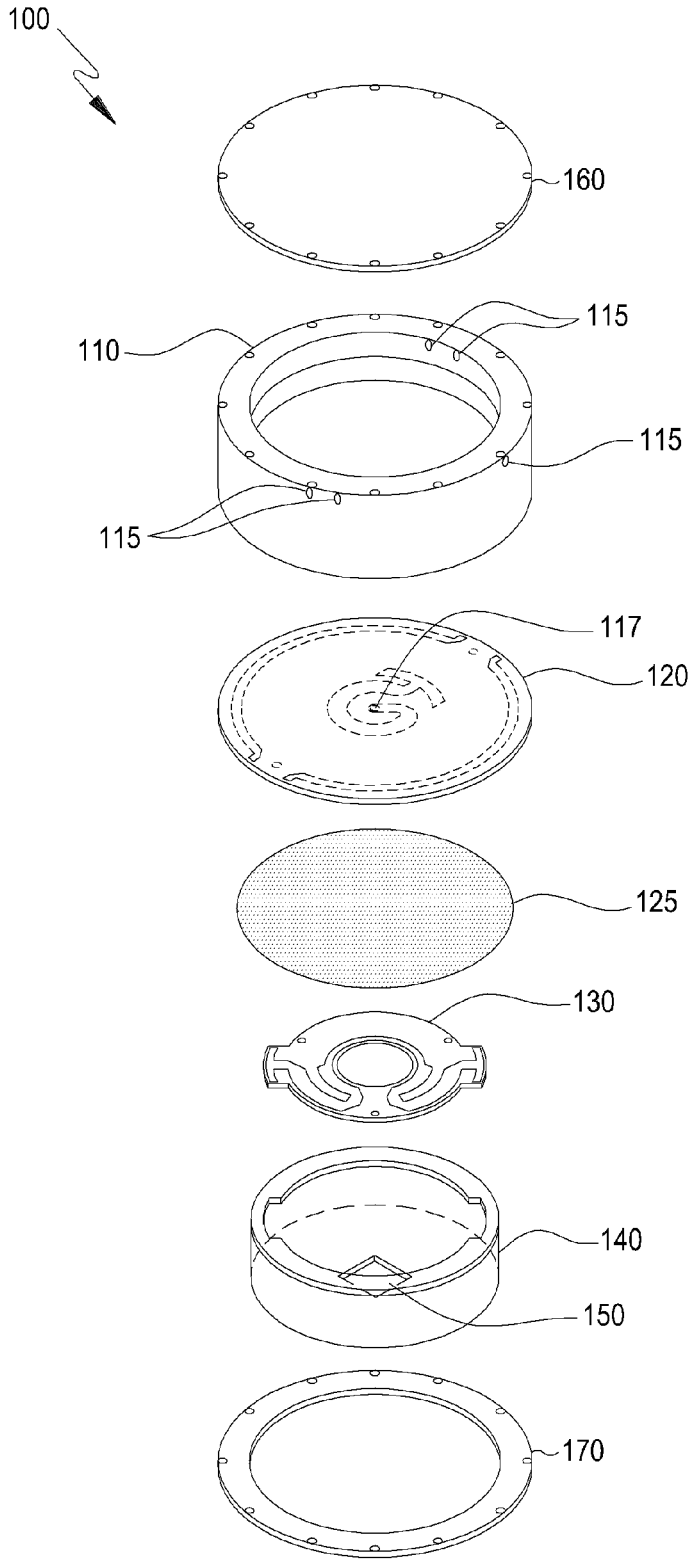
FIG. 1 is an exploded perspective view schematically illustrating a variable phase shifter according to an exemplary embodiment of the present invention.

FIG. 1 schematically illustrates a variable phase shifter according to an embodiment of the present invention.

As illustrated in FIG. 1, a variable phase shifter according to an embodiment of the present invention includes a cylindrical-shaped housing in which an appropriate receiving space is formed. A fixed board 120 and a rotating board 130 in the form of a disk are mounted in the cylindrical receiving space of the housing 110 in such a manner that they are contacted with each other. That is, the bottom surface of the fixed board 120 and the top surface of the rotating board 130 are mounted in such a manner as to come in contact with each other. Additionally, a thin insulating film 125 formed corresponding to each shape of the fixed board 120 and the rotating board 130, for example, in the form of a Photo-imageable Solder Resist (PSR) commonly used as a board surface processing scheme in manufacturing a printed circuit board, is mounted between the fixed and rotating boards coming into contact with each other, so that it is possible to prevent the fixed board 120 and the rotating board 130 from being directly connected to each other. The fixed board includes a via hole 117, which will be described with FIG. 2.

Also, the fixed board 120 and the rotating board 130 are only in contact with each other and are not coupled fixedly to each other. Consequently, on one hand, the rotating board 130 can come in close contact with the fixed board 120, and on the other hand, a surface of the rotating board 130, coming in contact with the fixed board 120, can slide when the rotating board 130 rotates in a manner as described below.

A rotating body 140 rotating by an external rotatory force is disposed in a lower portion of the rotating board 130, and is installed in the housing 110. A locking groove 150, for example, a rectangular locking groove, is formed in a lower portion of the rotating body 140, and thus the rotating body 140 can rotate in cooperation with an external motor (not shown).

While the fixed board 120 is fixedly mounted in the housing 110 in an appropriate manner, the rotating board 130 is coupled to the rotating body 140, so that the rotating board 130 rotates along with the rotation of the rotating body 140. Here, the rotating body 140 and the rotating board 130 coupled thereto rotate about the locking groove 150 in cooperation with the external motor. In the variable phase shifter 100 with such a structure, in a state where the fixed board 120, the rotating board 130, the rotating body 140, etc., are mounted in the housing 110, an upper cover 160 and a lower cover 170 are coupled to the upper and the lower portion of the housing 110, respectively, so as to support inner structures.

Hereinafter, the structures and operations of the fixed board 120 and the rotating board 130 will be described in more detail with reference to the accompanying drawings.

Figure 2:
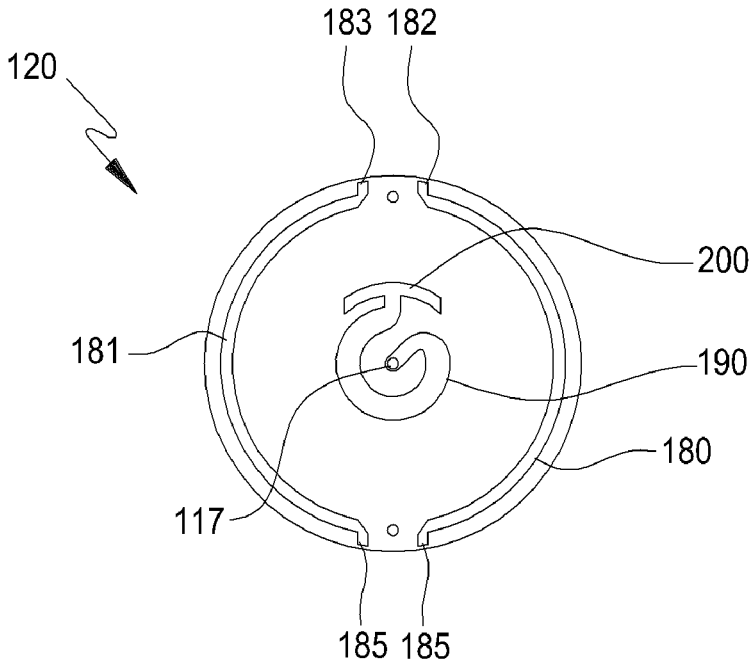
FIG. 2 is a plan view illustrating the structure of a fixed board in FIG. 1.
Figure 3:
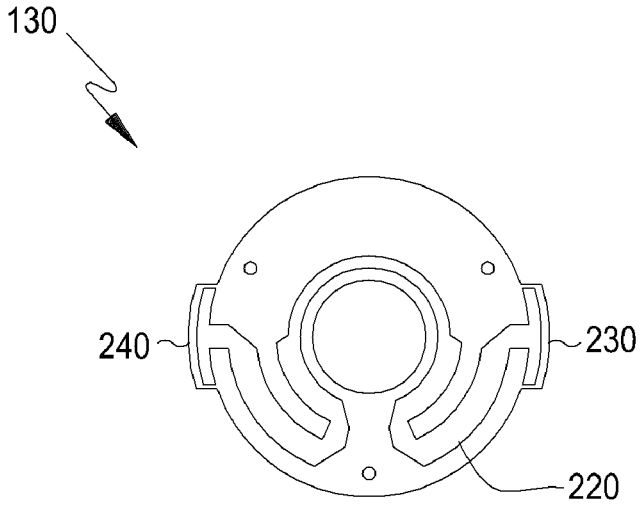
FIG. 3 is a plan view illustrating the structure of a rotating board in FIG. 1.
Figure 4:
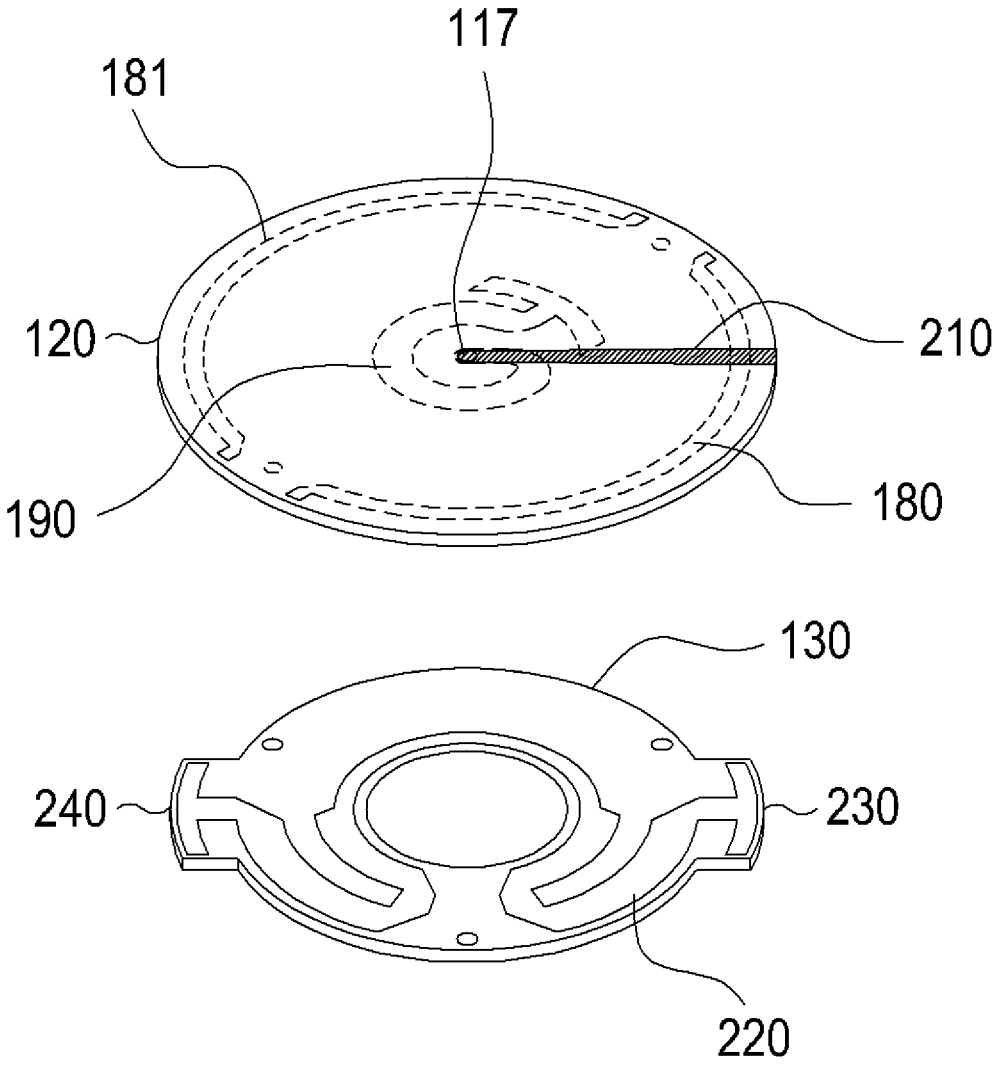
FIG. 4 is a detailed perspective view of the fixed board and the rotating board in FIG. 1.

FIG. 2 and FIG. 3 illustrate in plan view the structures of the fixed board and the rotating board in FIG. 1. FIG. 4 illustrates a detailed perspective view of the fixed board and the rotating board in FIG. 1.

Referring to FIG. 2 to FIG. 4, first, the fixed board 120 is formed by a disk-shaped dielectric with an appropriately set dielectric constant. Micro striplines 180, 190 are provided on the bottom surface of the fixed board 120. First and second arc-shaped output micro striplines 180, 181 are arranged along the outer circumference on the bottom surface of the fixed board, and a first transfer stripline 190 with an inner open end 200 is arranged around the center of the bottom surface of the disk-shaped fixed board 120.

Both ends of the arc-shaped first and second output micro striplines 180, 181, respectively, form first to fourth output ports 182, 183, 184 and 185.

Referring to FIG. 2, each of the first to fourth output ports 182, 183, 184 and 185 is connected to a connector (not shown) inserted into and coupled to one of through holes 115, which is arranged on a corresponding position in the housing 110 illustrated in FIG. 1, and finally connected to each radiating element (not shown) of an antenna through the connector.

Referring to FIG. 2, the first transfer stripline 190 with the open end 200 on the disk-shaped fixed board has a spiral shape starting from the center of the fixed board, and a via hole 117 is formed at the other end opposed to the open end 200 in order to receive an input signal from an input micro stripline 210 in FIG. 4.

In other words, since the first transfer stripline 190 with the open end 200 is connected to an end of the input micro stripline 210 through the via hole 117 formed at the other end of the first transfer stripline 190, an input signal is provided to the first transfer stripline 190.

Referring to FIGS. 2 and 4, additionally, the top surface of the fixed board 120 includes the input micro stripline 210 (FIG. 4) in order to receive an input signal by connecting to a connector (not shown) inserted into and coupled to one of the through holes 115 previously provided in the housing 13 and to transfer the input signal to the via hole 117 formed in the center of the fixed board 120. An input port is formed at the other end of the input micro stripline 210, and therefore a signal input into the input port of the input micro stripline 210 is provided to the first transfer stripline 190 (FIG. 4) through the via hole 117. Although the first transfer stripline 190 of the fixed board 120 is generally illustrated in the spiral shape, it may also have other various shapes.

Referring to FIGS. 3 and 4, meanwhile, the rotating board 130 generally has a micro stripline structure in the form of a meander line. That is, the rotating board 130 is disk-shaped, comes in contact with the bottom surface of the fixed board 120, and has rectangular-shaped projections on both sides thereof. A through hole is formed in the center of the rotating board 130. A second transfer stripline 220 in the form of a meander line, which is capacitively coupled to the output micro striplines 180, 181 and the first transfer stripline 190 of the fixed board 120, is arranged on the top surface of the rotating board 130 along the length according to frequencies as shown in FIG. 4. Both ends of the second transfer stripline 220 have openings 230, 240 in both the projections. The rotating board 130 with such a structure is constructed in such a manner as to be attached to the rotating body 140 when the rotating body 140 rotates.

FIG. 5 to FIG. 10 illustrate in plan view states where the fixed board 14 is disposed on the rotating board 15 in FIG. 1.

Figure 5:
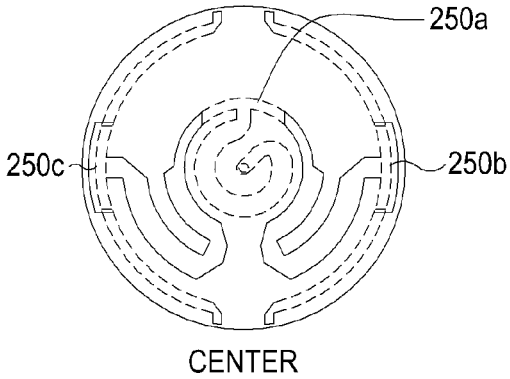
FIG. 5 to FIG. 10 are plan views illustrating various states in which the rotating board is placed on the fixed board in FIG. 1.

As illustrated in FIGS. 4 and 5, since the fixed board 120 (FIG. 4) as a dielectric board is formed on its bottom surface with the first and the second output micro striplines 180, 181 (shown in FIG. 4), and the top surface of the rotating board 130 (FIG. 4) is contacted with the bottom surface of the fixed board 120 by means of the meander line-shaped second transfer stripline 220 (FIG. 4) that is formed in an appropriate position corresponding to the first and the second output micro striplines 180, 181 of the bottom surface of the fixed board 120, it can be noted that they form a capacitive coupling structure among the micro striplines.

Furthermore, since the position of a first transition point 250*a* where the first transfer stripline 190 of the fixed board 120 is coupled to the second transfer stripline 220 varies with the rotation of the rotating board 130, the distances between the first transition point 250*a* and the openings 230, 240 of the second transfer stripline 220 are set to the wavelengths of lengths by contrast with the frequency of a transfer signal. In FIG. 5, the distances between the first transition point 250*a* of the open end 200 and both ends of the second transfer stripline 220 are equal, so that a signal transitioned from the open end of the first transfer stripline 190 to the second transfer stripline 220 on the top surface of the rotating board 130 is distributed to both ends of the second transfer stripline 220.

Figure 6:
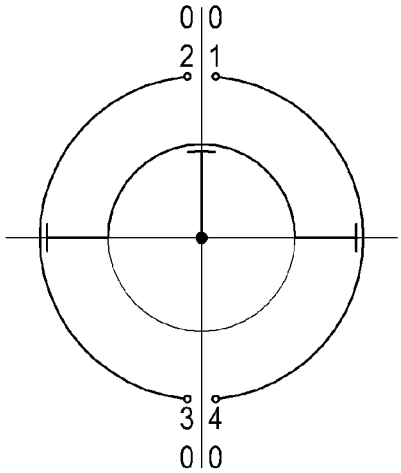

Here, since the openings 230, 240 (FIG. 4) on both sides of the second transfer stripline 220 form an open circuit, a point where the electromagnetic energy of the second transfer stripline 220 meets each of the output micro striplines 180, 181, that is, each of the openings 230, 240 assumes a Center position corresponding to each circular arc portion of the first output micro stripline 180 and the second output micro stripline 181, and a signal is radiated at a second transition point 250 b and a third transition point 250 c illustrated in FIG. 5. The signal radiated at the second transition point 250 b and the third transition point 250 c of the second transfer stripline 220 is transitioned to the first output micro stripline 180 and the second output micro stripline 181, respectively. FIG. 6 shows the phase shift at each output when the rotating board is at Center position. Output port 1 corresponds to the first output port 182, output port 2 corresponds to the second output port 183, output port 3 corresponds to the third output port 184, and output port 4 corresponds to the fourth output port 185. The phase differences at each output port depending on the rotation of the rotating board 130 are defined in the following Table 1. "0" refers to negligible to no phase difference, and "ϕ" refers to a phase difference denominator.

TABLE 1

| | | output port | | | |
|---|---|---|---|---|---|
| | | 1 | 2 | 3 | 4 |
| direction | Left | −3ϕ | +3ϕ | −ϕ | +ϕ |
| | Center | 0 | 0 | 0 | 0 |
| | Right | +3ϕ | −3ϕ | +ϕ | −ϕ |

Figure 7:
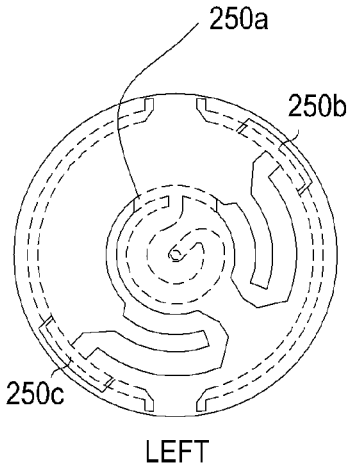
Figure 9:
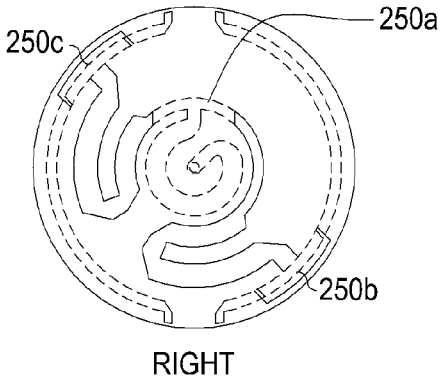

Referring to FIGS. 4, 5, 7, and 9, through the aforementioned structures of the fixed board 120 and the rotating board 130, a signal input into the input micro stripline 210 of the fixed board 120 is provided to the first transfer stripline 190 on the bottom surface through the via hole 117 as shown in FIG. 4, and then is transitioned from the first transition point 250 a (FIGS. 5, 7 AND 9) of the open end to the second transfer stripline 220 (FIG. 4) on the top surface of the rotating board 130. Subsequently, at the second transition point 250 b and the third transition point 250 c of the second transfer stripline 220, the signal is distributed and transitioned to the first output micro stripline 180 and the second output micro stripline 181 on the bottom surface of the fixed board. Accordingly, the signal is eventually distributed and output to the first to fourth output ports 182 to 185 of the first stripline 180 and the second stripline 181 as shown in FIG. 2. Here, as illustrated in FIGS. 5, 7 and 9, since the rotating board 130 (FIG. 4) is rotatably provided, positions corresponding to the second transition point 250 b and the third transition point 250 c vary on the first output micro stripline 180 and the second output micro stripline 181, and therefore the phase differences of the distributed signals output to the first to fourth output ports 182 to 185 also vary. Hereinafter, processes of transitioning, distributing and outputting the input signal will be described in more detail.

When a signal is input from the input micro stripline 210 formed on the top surface of the fixed board 120 through the input port, the signal is delivered to the bottom surface through the via hole 117. When the input signal enters the bottom surface of the fixed board 120, the signal is transferred to the first transfer stripline 190, and is transitioned to the second transfer stripline 220 of the top surface of the rotating board 130 because the open end 200 of the first transfer stripline 190 is physically open but electrically short-circuited at the first transition point 250*a*. The signal transitioned in this way is distributed to the second transition point 250*b* and the third transition point 250*c*.

A signal transferred to the second transition point 250*b* from among the signals distributed from the second transfer stripline 220 is transitioned to the first output micro stripline 180 on the bottom surface of the fixed board 120 because the first opening 230 of the second transfer stripline 220 is physically open but electrically short-circuited at the second transition point 250*b*. The signal transitioned to the first output micro stripline 180 is distributed to both sides thereof. The distributed signals are output to the first output port 182 and the fourth output port 185, respectively, and are provided to respective radiating elements (not shown) of the antenna.

Similarly, a signal transferred to the third transition point 250*c* from among the signals distributed from the second transfer stripline 220 is transitioned to the second output micro stripline 181 on the bottom surface of the fixed board 120 because the second opening 240 of the second transfer stripline 220 is physically open but electrically short-circuited at the third transition point 250*c*. The signal transitioned to the second output micro stripline 181 is distributed to both sides thereof. The distributed signals are output to the second output port 183 and the third output port 184, respectively, and are provided to respective radiating elements (not shown) of the antenna. In conclusion, a signal input through the input port of the input micro stripline 210 is distributed and output into four signals.

With regard to this, the phase differences of the signals output through the first to fourth output ports 182 to 185 are determined by a rotation state of the rotating board 130 coupled to the rotating body 140, that is, the position of a transition point of the second transfer stripline 220 on the top surface of the rotating board 130, which depends on the rotation state of the rotating board 130.

Figure 8:
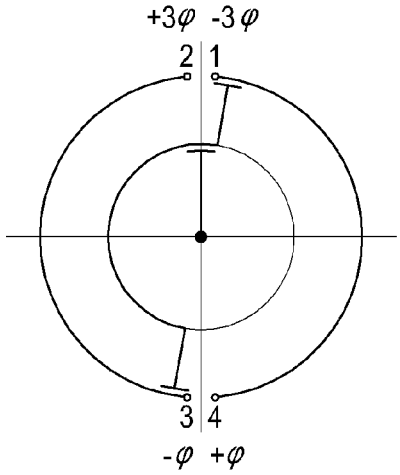

For example, in a Left position with FIG. 7, when the second transition point 250 b is located in the position closer to the first output port 182 than the fourth output port 185, a signal transitioned at the transition point is distributed in the directions of the first output port 182 and the fourth output port 185, and thus the transmission line of the signal output through the fourth output port 185 gets longer than that of the signal output through the first output port 182. In this way, a phase difference between the signals output through the first and fourth output ports 182, 185 is generated by the different lengths of the transmission lines of the signals distributed from the first output micro stripline 180 to each of the first and fourth output ports 182, 185. FIG. 8 shows the phase shift at each output when the rotating board 130 is at Left position. Output port 1 corresponds to the first output port 182, output port 2 corresponds to the second output port 183, output port 3 corresponds to the third output port 184, and output port 4 corresponds to the fourth output port 185. Here, a phase difference (i.e. −3ϕ, −ϕ, +ϕ, +3ϕ) at each output port is defined in Table 1 above.

Figure 10:
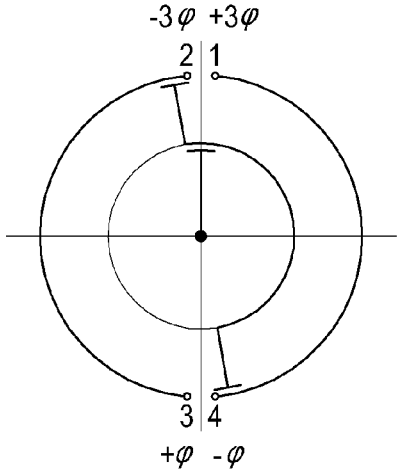

Similarly, as illustrated in FIG. 9, a signal transitioned at the third transition point 250 c in a Right position is distributed and output with phase difference through the second and the third output ports 183, 184 of the second output micro stripline 181. FIG. 10 shows the phase shift at each output when the rotating board 130 is at Right position. Output port 1 corresponds to the first output port 182, output port 2 corresponds to the second output port 183, output port 3 corresponds to the third output port 184, and output port 4 corresponds to the fourth output port 185. The phase difference (i.e. $-3\phi$, $-\phi$, $+\phi$, $+3\phi$) is defined in Table 1 above.

Meanwhile, the phase differences among the signals output through both the output ports 182, 185 of the first output micro stripline 180 and both the output ports 183, 184 of the second output micro stripline 181 are different from one another because the first and the second output micro striplines 180, 181 of the fixed board 120 are constructed in such a manner as to have different line lengths. For example, when the phase difference between the signals output through the second and the third output ports 183, 184 of the second output micro stripline 181 is so designed as to range from $+3\phi$ to $-3\phi$, the phase difference between the signals output through the both output ports 182, 185 of the first output micro stripline 180 may be so designed as to range from $-3\phi$ to $+3\phi$, so that it is possible to vary the phase difference at each output port.

A variable phase shifter according to an embodiment of the present invention may be designed and operate as described above. While the invention has been shown and described with reference to specific embodiments thereof, it will be understood by those skilled in the art that various changes in forms and details may be made therein without departing from the spirit and scope of the invention as defined by the appended claims.

The invention claimed is:

1. A variable phase shifter comprising:

a circular housing having a center;

a circular fixed board fixedly provided within the housing, receiving an input signal through a first transfer stripline provided on one surface thereof, which is a micro stripline, and having at least one arc-shaped output micro stripline radially outside the first transfer stripline;

a rotating board being rotatable about the center within the housing, while maintaining contact with the one surface of the circular fixed board, and having a second transfer stripline on a surface thereof, where the rotating board comes in contact with the one surface of the circular fixed board; and wherein coupling between the first and second transfer striplines and the at least one arc-shaped output micro stripline define at least one variable signal path, the at least one variable signal path varying with the rotation of the rotating board, the second transfer stripline being arc-shaped to maintain signal transfer with the first transfer stripline while the rotating board is being rotated, and at least one end of the second transfer stripline maintains signal transfer with the at least one arc-shaped output micro stripline.

2. The variable phase shifter of claim 1, wherein the circular fixed board comprises an input micro stripline connected to an input port on the other surface thereof.

3. The variable phase shifter of claim 2, wherein the input micro stripline comprises a via hole at one end thereof, through which an input signal is provided to the first transfer stripline.

4. The variable phase shifter of claim 1, wherein the second transfer stripline is coupled to the first transfer stripline from an open end of the first transfer stripline.

5. The variable phase shifter of claim 4, wherein the second transfer stripline comprises openings at both ends thereof and the second transfer stripline is arranged in different lengths according to frequencies.

6. The variable phase shifter of claim 5, wherein the at least one arc-shaped output micro stripline coupled to the second transfer stripline from the openings of the second transfer stripline provide at least one output signal.

7. The variable phase shifter of claim 1, wherein an insulating film, which is formed according to each shape of the circular fixed board and the rotating board, is mounted between the respective surfaces where the circular fixed board and the rotating board come in contact with each other.

8. A variable phase shifter comprising:

a circular housing having a center;

a circular fixed board fixedly provided within the housing, having a first transfer stripline on one surface thereof, which is a micro stripline, having a via hole at one end of an input micro stripline on the other surface thereof, which is connected to an input port, so as to provide an input signal to the first transfer stripline, and consisting of a dielectric board, having two arc-shaped output micro striplines radially outside the first transfer stripline;

a rotating board being rotatable about the center within the housing while maintaining contact with the one surface of the circular fixed board, and having a second transfer stripline on a surface thereof where the rotating board comes in contact with the one surface of the circular fixed board;

an insulating film formed according to each shape of the circular fixed board and the rotating board, and mounted between the respective surfaces where the circular fixed board and the rotating board are in contact with each other; and a rotating body coupled to the rotating board, and rotating the rotating board by means of an external force, wherein the coupling between the two output micro striplines and the first and second transfer striplines defines at least one variable signal path, the at least one variable signal path varying with the rotation of the rotating body, the second transfer stripline being arc-shaped to maintain signal transfer with the first transfer stripline while the rotating board is being rotated, and at least one end of the second transfer stripline maintains signal transfer with the at least one arc-shaped output micro stripline.

9. The variable phase shifter of claim 8, wherein the second transfer stripline is coupled to the first transfer stripline from an open end of the first transfer stripline.

10. The variable phase shifter of claim 8 or 9, wherein the second transfer stripline comprises openings at both ends thereof and the second transfer stripline is arranged in different lengths according to frequencies.

11. A variable phase shifter comprising:

a circular housing having a center;

a first transfer microstrip line disposed within the housing;

at least one arcuate at least one output microstrip line disposed within the housing, the output microstrip line being concentric with and surrounding the first transfer stripline;

a circular rotating member being rotatable within the housing about the center, the rotating member including a second transfer stripline configured to maintain coupling with the first transfer stripline and the at least one arcuate output microstrip line; and wherein the coupling between the first and second transfer striplines and the at least one arcuate output microstrip line defines a signal path having a length, the length varying with the rotation of the circular rotating member relative to the housing, the second transfer stripline being arcuate to maintain signal transfer with the first transfer stripline while the rotating member is being rotated, and at least one end of the second transfer stripline maintains signal transfer with the at least one arcuate output microstrip line.

12. The variable phase shifter of claim 11, wherein the at least one arcuate output microstrip line comprising two arcuate output microstrip lines.

13. The variable phase shifter of claim 11, the second transmission transfer microstrip line having two equally-spaced open ends.

14. The variable phase shifter of claim 13, each open end of the second transfer microstrip line being in contact with the at least one arcuate output microstrip line.

15. The variable phase shifter of claim 11 further comprising an insulating member, the insulating member disposed between the second transfer stripline and both the at least one arcuate output microstrip line and the first transfer stripline.

16. The variable phase shifter of claim 15, the insulating member having a circular shape.

* * * * *